US006492083B1

(12) United States Patent
Livengood et al.

(10) Patent No.: US 6,492,083 B1
(45) Date of Patent: Dec. 10, 2002

(54) TONER COMPRISING WAX AND FUNCTIONALIZED ENHANCING AGENT

(75) Inventors: Bryan P. Livengood, Boulder, CO (US); Michelle K. Morris, Lexington, KY (US); John M. Olson, Boulder, CO (US); Jodi P. Walsh, Berthoud, CO (US); Franklin D. Zartman, Loveland, CO (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/853,235

(22) Filed: May 11, 2001

(51) Int. Cl.[7] ..... G03G 9/08
(52) U.S. Cl. ..... 430/108.4; 430/108.8
(58) Field of Search ..... 430/108.4, 108.8, 430/108.1

(56) References Cited

U.S. PATENT DOCUMENTS

| | | | | |
|---|---|---|---|---|
| 3,775,326 | A | | 11/1973 | Westdale |
| 3,944,523 | A | | 3/1976 | Gobran |
| 3,988,817 | A | | 11/1976 | Thettu |
| 4,752,534 | A | | 6/1988 | Koshizuka et al. |
| 4,764,571 | A | | 8/1988 | Namba et al. |
| 4,971,882 | A | | 11/1990 | Jugle |
| 5,089,587 | A | | 2/1992 | Namba et al. |
| 5,176,978 | A | | 1/1993 | Kumashiro et al. |
| 5,225,303 | A | | 7/1993 | Tomita et al. |
| 5,270,144 | A | | 12/1993 | Moriya |
| 5,292,609 | A | | 3/1994 | Yoshikawa et al. |
| 5,424,162 | A | | 6/1995 | Kohri et al. |
| 5,466,555 | A | | 11/1995 | Taguchi et al. |
| 5,643,705 | A | | 7/1997 | Inoue et al. |
| 5,741,617 | A | | 4/1998 | Inaba et al. |
| 5,783,719 | A | | 7/1998 | Sun et al. |
| 5,814,428 | A | * | 9/1998 | Kido et al. ..... 430/108.8 |
| 5,824,446 | A | | 10/1998 | Nishihara et al. |
| 5,840,456 | A | | 11/1998 | Tomita et al. |
| 5,843,612 | A | | 12/1998 | Lin et al. |
| 5,853,940 | A | | 12/1998 | Kido et al. |
| 5,858,596 | A | | 1/1999 | Tajima et al. |
| 5,866,291 | A | | 2/1999 | Ikegami et al. |
| 5,869,694 | A | | 2/1999 | Furukawa et al. |
| 5,914,209 | A | | 6/1999 | Grushkin |
| 5,948,583 | A | | 9/1999 | Silence et al. |
| 5,959,056 | A | | 9/1999 | Beach et al. |
| 5,962,177 | A | | 10/1999 | Sacripante et al. |
| 5,972,553 | A | | 10/1999 | Katada et al. |
| 5,986,017 | A | | 11/1999 | Katagiri et al. |
| 6,232,027 | B1 | * | 5/2001 | Matsunaga et al. ..... 430/108.3 |

FOREIGN PATENT DOCUMENTS

| | | | |
|---|---|---|---|
| EP | 001094367 | A1 * | 4/2001 |
| JP | P2000-10338 | A | 1/2000 |

OTHER PUBLICATIONS

Diamond, Arthur S. (editor) Handbook of Imaging Materials. New York:Marcel–Dekker, Inc. p. 170. (1991).*

* cited by examiner

*Primary Examiner*—Christopher Rodee
(74) *Attorney, Agent, or Firm*—John A. Brady

(57) ABSTRACT

Toner particulates include a release agent which comprises a functionalized enhancing agent and a wax. The toner particulates may be used to improve dry fuser release and to improve color clarity in overhead transparencies.

25 Claims, No Drawings

TONER COMPRISING WAX AND FUNCTIONALIZED ENHANCING AGENT

FIELD OF THE INVENTION

This invention relates to release agents, toner particulates and toner compositions. This invention also relates to methods of improving dry fuser release for the prevention of fuser jamming and fuser wrapping, and of methods of improving overhead projection transparencies.

BACKGROUND OF THE INVENTION

Numerous methods and apparatuses for electrophotography, electrostatic recording and electrostatic printing are known in the art. Typically, a charged photosensitive surface, for example a charged photosensitive drum, is irradiated with an optical image and an electrostatic latent image is formed on the photosensitive surface. In the development process, a developing agent, i.e., toner, is adhered to the electrostatic latent image.

Typically, toner is fed to a developer roller by a metering blade positioned against the surface of the developing roller. The developer roller, with the toner on its surface, is typically rotated in a direction opposite to that of the photosensitive drum (or in the same direction at a different speed), and toner adheres to the electrostatic latent image to develop the image. Various toner compositions have been developed in order to provide improved copying, recording and/or printing with such apparatus.

One method of fusing a toner image to a substrate is to bring the toner in contact with a hot surface such as a heated roller. However, there is a tendency for a fuser to collect small amounts of toner which in turn causes toner offset to build up on the fuser surface. This toner may be then transferred to a subsequent substrate, thereby causing a poor image.

The fuser roll surface may be wetted with a release agent such as a silicone oil in order to decrease the problem of toner offset. Unfortunately, the silicone oil release agent may leave oil residues on the paper, thereby interfering with the image quality. Additionally, the release agent material tends to migrate to other surfaces within the printer where it interferes with proper development of the latent image to diminish print quality, especially in the case of duplex printing. Therefore, a dry fuser, that is a fuser without any oil on its surface, is often desirable.

In order to solve the problem of toner offset with dry fusers, lubricants or waxes are often added to the toner. Unfortunately, at high concentrations effective for the purpose of dry fuser release many conventional lubricants tend to separate from the toner during the process of development, and stick to the doctor blade causing a filming problem which adversely affects print quality.

Toner release from dry fusers has been enhanced by modification of toner resin rheology. High molecular weight resins or resins having crosslinks may exhibit improved release. Unfortunately, use of such high molecular weight or crosslinked resins generally results in poor clarity of overhead projection transparencies or in inadequate fuse grade at higher speeds. Generally, high transparency or excellent high speed fuse grade requires lower melt temperature resins or higher fusing temperatures, but such resins or temperatures cause toners to adhere easily to dry fuser rollers. Thus, it is difficult to develop toners for transparencies or lower temperature fusing applications which exhibit good release, good fuse grade and the good transparency needed for reproduction of a large color gamut and for clarity. Generally, in order to maintain good clarity and high speed fuse grade, the lower melt temperature resins used in toners require that a separate release agent be used.

Tomita et al., U.S. Pat. No. 5,225,303, disclose a toner comprising binder resin, coloring agent, and a release agent, which contains as the main components a carnauba wax substantially free of aliphatic acids and/or a montan ester wax, and an oxidized rice wax with an acid value of 10 to 30. Tomita et al. teach that the acid value of the montan ester wax is preferably in the range of from 5 to 14, and that the carnauba wax preferably comprises 5 weight percent or less free aliphatic acids.

Inoue et al., U.S. Pat. No. 5,643,705, disclose a toner comprising a toner particulate containing a polyolefin wax and a modified polyolefin wax. Inoue et al. disclose the polyolefin wax is a low number-average molecular weight polyethylene or low number-average molecular weight polypropylene having a softening point of from 80° C. to 160° C., and that the modified polyolefin wax is mainly composed of low number-average molecular weight polyethylene, wherein the modifying component used to modify the polyolefin wax is an aromatic vinyl monomer, an acrylate monomer, an unsaturated dicarboxylic acid ester or a mixture thereof.

Taguchi et al., U.S. Pat. No. 5,466,555, disclose a releasing composition comprising 60 to 99.5% by weight of a low molecular weight polypropylene having a melt viscosity of 15 to 2,000 cps at 160° C., and 0.5 to 40% by weight of at least one modified polyolefin selected from the group consisting of low molecular weight polypropylene having a melt viscosity at 160° C. higher than that of the first polypropylene, modified with an ethylenically unsaturated carboxylic acid or an anhydride thereof, and a modified polyethylene comprising a low molecular weight polypropylene having a melt viscosity of 10 to about 8,000 cps at 1 40° C., modified with an ethylenically unsaturated carboxylic acid or an anhydride thereof.

Katada et al., U.S. Pat. No. 5,972,553, disclose a toner comprising polymer components, a colorant, a charge control agent, and a wax terminally modified with at least one of maleic acid, maleic acid half ester, or maleic anhydride. Katada et al. teach that the polymer components include a low molecular weight polymer component having an acid value $A_{vl}$ and a high molecular weight polymer component having an acid value $A_{vh}$ such that $A_{vl}$ is greater than Avh. Katada et al. further teach that the wax has an acid value $A_{vwax}$ satisfying $A_{vl}>A_{vwax}$, and $A_{vwax}>0$ mg KOH/g, and that the wax may have an acid value of 1 to 15.

Unfortunately, many prior art toner compositions comprise large amounts of release agents such as waxes, and such large amounts tend to interfere with print quality. Other prior art toners comprising waxes have a poor fuse grade, that is, the print is not resistant to abrasion and may be abraded or scraped off. Some waxes, such as polyolefin waxes, tend to migrate to the photoreceptor causing poor print quality, or causing staining of the photoreceptors. Further, many color toners which contain release agents fail to exhibit both good release and the good transparency needed for reproduction of a large color gamut and for clarity.

In the pursuit of high quality, vibrantly colored overhead transparencies, it has been discovered that the achievement of this goal through electrophotography is dependent not only upon the inherent transparency of the binder resin, but upon the release/transparency (r/t) window of said binder resin. The r/t window of a toner is defined as that range of temperatures in which a toner is sufficiently fused to produce a bright, colorful image when projected and where it releases cleanly from the fuser hot roll. This window is the cross section of the independent release and transparency windows. Each resin system has its own characteristic cross section. "Release" refers to the tendency of a developed image to wrap the fuser roll upon nip exit at a given temperature. The release window is a range of temperatures bounded at the low end by cold offset and at the high end by fuser adhesion or hot offset. "Transparency" refers to the ability of a toner to transmit light without scatter. The transparency window can be measured by evaluating the percentage transmitted light through a sample that has been fused at a given temperature. It is a range of temperatures bounded by low fuse grade, characterized by muddy projected color, and hot offset, where the rough toner surface begins to scatter light. The overlap of the release range and the transparency range of a given toner at a specific mass per unit area is the release/transparency window for that toner.

It is desirable that the r/t window be wide and achievable at temperatures sustainable for the lifetime of a fuser assembly. Typically the range of temperatures where a binder resin achieves transparency corresponds to the onset of fuser wrapping. The properties that lead to excellent transparency, low molecular weight, low melt temperatures, low viscosity, and low gel content, also generally yield poor wrapping, filming, and hot offset performance.

These principles of release may also be applied to black toners. The market trend is not merely to color toner but also toward higher speed printing. Though obviously lacking any requirement for the achievement of transparency, like requirements for the projection of color, high speed fusing requires toners with rapid melting characteristics. Black toners must achieve adequate fuse grade, sufficient melting of the toner powder to cause tenacious adhesion of the toner image to the substrate. Black toners may be said to have a release/fuse grade window analogous to the release/transparency window defined above for color toners. Like with the color example, the properties that support rapid fusing, low molecular weight, low melt temperatures, low viscosity, and low gel content, generally yield poor wrapping, filming, and hot offset performance.

High molecular weight resins may release effectively but cannot achieve a satisfactory transparency or fuse grade at temperatures that can be maintained without damage to the fuser assembly. Crosslinked resins may contain sufficient elasticity to release at a wide range of temperatures, but are likely to be characterized by low fuse grade. The balance of release and transparency/fuse grade is difficult to achieve with resin chemistry alone. Conventional solutions to this challenge include the incorporation of release agents, such as polypropylene waxes, into the toner formula, or the application of low melt release agents, such as silicone oil, to the surface of the hot roll. Chemically polymerized toners using high levels of encapsulated wax have also appeared. Though these methods are each utilized in the industry each has its own disadvantages.

The level of internal release agent required for adequate release in low melt systems is generally high, forming large domains of incompatible material, and therefore usually accompanied by a strong tendency to film the electrophotographic (EP) components. This filming leads to the destruction of image quality. Higher levels of internal wax in conventional toner can be achieved through the use of compatibilizing agents, but these agents tend to decrease the effectiveness of the wax and also have a negative effect on transparency. Chemically prepared toners (CPTs) with high levels of encapsulated wax suffer from haze. Though use of an oiled hot roll avoids the occurrence of filming and the appearance of haze, the oil has a tendency to migrate. This migration of oil results in the disruption of the duplexing capability of the machine. Metering mechanisms have been designed to limit the amount of oil flowing through the system at any given time. These metering devices, however, are expensive and dramatically increase the price of a printer.

Thus, there is a need for methods of improving toner release which produce high image quality overhead transparencies with vibrant projected color. Particularly, there is a need for methods of improving or enhancing toner release which avoids the need for expensive metering mechanisms. Further, there is a need for release agents which may be incorporated into toner particles thereby providing toner compositions with adequate fuse grade and good dry fuser roller release, and which provide good print quality and acceptable clarity for overhead projection transparencies. The release agent should not promote smearing or blocking of toner, or filming on the doctoring blade, developer roller or the photoconductor drum.

SUMMARY OF THE INVENTION

Accordingly, an object of this invention is to provide improved release agents, toner particulates and toner compositions.

It is another object of this invention to provide methods for improving dry fuser roller release.

It is a further object of this invention to provide methods of improving color clarity in overhead projection transparencies.

It is yet another object of this invention to provide toner compositions having adequate fuse grade.

It is yet another object of this invention to avoid component contamination by residual oil by using an oil-free dry fuser roller and toners which release from the dry fuser roller without filming.

It is yet another object of the invention to provide toner compositions exhibiting good dry fuser roller release.

In accordance with one aspect of the invention there are provided release agents comprising, by weight, no more than about 50% wax and at least about 50% functionalized enhancing agent, while in accordance with another aspect of the invention there are provided release agents comprising from about 15% to about 75%, by weight, wax and from about 25% to about 85%, by weight, functionalized enhancing agent. The wax has a number-average molecular weight of no greater than about 10,000.

In accordance with one aspect of the invention there are provided toner particulate comprising a release agent comprising wax and functionalized enhancing agent; wherein the release agent comprises, by weight of total release component, no more than about 50% wax and at least about 50% functionalized enhancing agent, while in accordance with another aspect of the invention there are provided toner particulates comprising a toner binder resin, a colorant, a charge controlling additive and a release agent, wherein the release agent comprises from about 15% to about 75%, by weight, wax and from about 25% to 85%, by weight, functionalized enhancing agent. The wax has a number-average molecular weight of at no greater than about 10,000.

In accordance with one aspect of the invention there are provided methods of improving the release/transparency window of an overhead projection substrate of a color toner image using a low oil or oil-less fuser roll comprising the step of printing the overhead projection substrate with a composition comprising toner particulates, wherein the toner particulates comprise a colorant, resin and a release agent comprising, by weight of total release agent, no more than about 50% of a wax having an acid value of no more than about 10 and a number-average molecular weight of at no greater than about 10,000, and at least about 50% of a functionalized enhancing agent having an acid value of from about 10 to about 100.

In accordance with yet another aspect of the invention there are provided methods of improving dry fuser release of a toner composition, comprising the step of providing the toner composition with a release agent, wherein the release agent comprises, by weight, no more than about 45% wax and at least about 55% functionalized enhancing agent.

In accordance with yet another aspect of the invention there are provided toner compositions comprising a wax, and a functionalized enhancing agent comprising a polyalkylene having at least one maleic half ester moiety grafted onto the polyalkylene.

Additional embodiments and advantages of the toner compositions, toner particulates, release agents and methods herein will be apparent from the following description.

DETAILED DESCRIPTION

It is desirable that toner compositions readily release from dry fuser rollers, exhibit good fuse grade and provide prints having good print quality. It has been found that toner particulates comprising the combination of a functionalized enhancing agent and a wax provide for toner having good release from dry fusers and prints which have good print quality and acceptable fuse grade. The combination of a functionalized enhancing agent and a wax, in addition to its use as a release agent in toner particulates, may also serve as a release agent in various other environments and applications, for example, as a coating for molds.

Although large amounts of wax in toners, such as more than about 3%, by weight, improves fuser release, such large amounts of wax often have deleterious effects on overall print quality. Generally, large amounts of wax result in toners having large wax domains, and if the wax domains are too large, poor print quality results.

It is commonly known that increased amounts of wax can be incorporated into toner particulates through the use of wax compatibilizers. These compatibilizers act to increase the miscibility of the wax in the toner resin matrix and result in smaller domain sizes than realized with a similar amount of wax alone. With compatibilization a larger amount of total wax can be utilized in the toner without an increase in the average wax domain size. This increase in total wax content, however, is not accompanied by an increase in the release window of the toner. Compatibilized wax loses release potency and therefore, though functional at higher loading levels than uncompatibilized wax from a print quality viewpoint, does not allow for improved release performance. It has also been noted that the addition of compatibilizers to color toners introduce haze which is undesirable for color reproduction.

In an effort to simultaneously achieve high image quality overhead transparencies, long component lifetime, vibrant projected color or high speed fusing and duplex capability at a competitive price, it has been necessary to discover an alternate method for release enhancement. The inventors have found that an operable release window can be obtained through the use of a release agent comprising a wax and a functionalized enhancing agent in the form of a synergistic blend. This blend allows the incorporation of a higher level of total release agent than that achievable with a single wax while avoiding the filming and haze typical of high levels of wax or compatibilized wax. Enhancement of the release characteristics of the toner itself without increasing filming tendency allows release from a dry fuser hot roll, eliminating the need for oil. Such toners provide for overhead projection transparencies having a good color gamut and clarity as well as black toners with significantly improved release characteristics and satisfactory fuse grade even at high speeds.

As used herein, fuse grade, refers to resistance of the toner to abrasion. Toners with adequate fuse grade are resistant to abrasion, while toners with poor fuse grade may be abraded away or scraped off. "Dry fuser release" refers to the ability of the toner to be released from a fuser which is not oiled or treated with a release agent such as the silicone oil.

As used herein, "release agent" refers to a blend of a functionalized enhancing agent and a wax. In one embodiment the release agent generally comprises, by weight of the total release agent, at least about 50%, preferably at least about 55%, more preferably at least about 60%, functionalized enhancing agent and no more than about 50%, preferably no more than about 45%, more preferably no more than about 40%, wax. The functionalized enhancing agent may be comprised of a single functionalized enhancing agent, or may be a mixture of more than one functionalized enhancing agent. The wax may be comprised of a single wax, or may be a mixture of more than one wax. Generally the release agent comprises, by weight, a greater amount of functionalized enhancing agent than of wax. In one embodiment, the weight ratio of the wax to the functionalized enhancing agent is from about 1:0.8 to about 1:9, preferably from about 1:1 to about 1:9, more preferably from about 1:1 to about 1:3, while in another embodiment, the weight ratio of the wax to the functionalized enhancing agent is from about 1:1 to about 1:50, preferably from about 1:1 to about 1:10.

As used herein "functionalized enhancing agent" is intended to refer to a compound comprising at least one functional group, that is at least one moiety other than a hydrocarbon group, and which serves to enhance the ability of a wax to release toner from a fuser roll. The functionalized enhancing agent is generally not adequate to serve as a wax by itself because it is unable to release the toner from the fuser roller or prevent paper jamming in the fuser assembly at levels that do not cause unacceptably high levels of filming. As used herein, "unable to release toner from the fuser roller" indicates that a wax-free toner comprising 4%, by weight, functionalized enhancing agent exhibits a release score greater than zero, "prevent paper jamming" indicates that a wax-free toner comprising 4%, by weight, functionalized enhancing agent yields no paper jams in 100,000 printed pages, while "unacceptably high levels of filming" indicates that a wax-free toner comprising 4%, by weight, functionalized enhancing agent exhibits film onset after printing no more than about 10,000 pages. The functionalized enhancing agent is also not a wax compatibilizer, that is, the addition of the functionalized enhancing agent to a wax does not cause a decrease in the domain size of the resulting wax/functionalized enhancing agent blend. However, the functionalized enhancing agent is able to enhance the functioning of the wax in the toner particulate.

The principles stated above, and therefore the need for this invention, can be simply summarized in the following table. Toners with good release exhibit release scores of less than about 360, while toners with good filming performance do not exhibit filming for at least about 10,000 pages. An acceptable release agent domain size, dependent upon the resin matrix, is from about 1 to about 6 micrometers.

TABLE 1

Toner Characteristics Which May Be Effected By Release Agents

| | EFFECTS | | | | |
|---|---|---|---|---|---|
| Release Agent | Release | Fusegrade | Filming Performance | Print Quality | Release Agent Domain Size |
| Wax Only | FAIR | FAIR | GOOD | GOOD | ACCEPTABLE |
| Wax + extra wax | GOOD | GOOD | POOR | POOR | VERY LARGE |
| Wax + extra wax + compatibilizer | FAIR | GOOD | GOOD | FAIR | ACCEPTABLE |
| Wax + compatibilizer | POOR | FAIR | GOOD | GOOD | VERY SMALL |
| Wax + Enhancer | GOOD | GOOD | GOOD | GOOD | ACCEPTABLE |

A functionalized enhancing agent may comprise a moiety selected from the group consisting of unsaturated carboxylic acids, anhydrides of unsaturated carboxylic acids, esters of unsaturated carboxylic acids, aromatic vinyl monomers and mixtures thereof. Preferably the functionalized enhancing agent is a low molecular weight polymer comprising acid or ester linkages as a side chain or as a terminal functional group. As used herein, "low molecular weight polymer" is intended to refer to a polymer having a number-average molecular weight of less than about 15,000.

In one embodiment the functionalized enhancing agent comprises a polyalkylene wherein at least one ester moiety, preferably a maleic half ester moiety, is grafted onto the polyalkylene. As used herein, "intermediate position" refers to a position on the polyalkylene backbone other than the terminal position. The functionalized enhancing agent may comprise an ester grafted onto a terminal position, provided the functionalized enhancing agent also comprises at least one ester grafted onto an intermediate position. In another embodiment the functionalized enhancing agent is an oxidized paraffin.

The "acid value," also referred to as acid number, is measured as the number of milligrams of potassium hydroxide needed to neutralize one gram of wax. Thus, a wax having an acid value of 10 requires 10 mg of KOH to neutralize one gram of wax. In one embodiment the functionalized enhancing agent has an acid value of at least about 10, preferably at least about 20, more preferably at least about 25, and no greater than 150, more preferably no greater than about 100, more preferably no greater than about 75. In one embodiment the functionalized enhancing agent has an acid value in the range of from about 10 to about 150, preferably from about 15 to about 100, and more preferably from about 20 to about 70.

In one embodiment the functionalized enhancing agent generally has a number-average molecular weight of no more than about 15,000, preferably no more than about 10,000, more preferably no more than 8,000. In another embodiment the functionalized enhancing agent has a number-average molecular weight of from about 400 to about 15,000, preferably from about 500 to about 10,000, and more preferably from about 500 to about 6,000. In one embodiment the functionalized enhancing agent may have a melting point of from about 60° C. to about 125° C., preferably from about 70° C. to about 115° C. The functionalized enhancing agent may have a heat of fusion in the range from about 100 to about 250 J/g. In one embodiment the functionalized enhancing agent is an oxidized paraffin having a melting point of from about 80° C. to about 115° C.

As used herein "wax" is intended to include waxes which have an acid value of no greater than about 20. In one embodiment the wax has an acid value of less than about 20, preferably less than about 10, more preferably less than about 5. In a further embodiment the wax has an acid value of no greater than 2. The wax may be substantially free, preferably free of, acid or ester linkages in the backbone of the polymer, as a side chain, or as a terminal functional group. As used herein "substantially free of acid or ester linkages" indicates the wax comprises less than 5% acid and ester linkages.

Waxes suitable for use in toners include polyolefin waxes, metal salts of fatty acids, fatty acid esters, partially saponified fatty acid esters, higher fatty acid esters, higher alcohols, paraffin waxes, amide waxes, and polyhydric alcohol esters. Suitable polyolefins include polypropylenes, polyethylenes, polybutenes, polypropylene =polyethylene copolymers, and blends comprising polyethylenes, polypropylenes or poly α-olefins. Suitable metal salts of fatty acids include metal salts of maleic acid adducts of saturated hydrocarbons, metal salts of stearic acid, metal salts of oleic acids, metal salts of palmitic acids, metal salts of linoleic acids and metal salts of ricinoleic acid. Suitable fatty acid esters include ethylmaleate, butylmaleate, methyl stearate, butyl stearate, cetyl palmitate, and ethylene glycol montantae. Partially saponified fatty acid esters include montanic acid esters partially saponified with calcium. Higher fatty acids include dodecanoic acid, lauric acid, myristic acid, palmitic acid, stearic acid, oleic acid, linoleic acid, ricinoleic acid, arachic acid, behenic acid, lignoceric acid, selacholeic acid.

Suitable higher alcohols include dodecyl alcohol, lauryl alcohol, myrisyl alcohol, palmityl alcohol, stearyl alcohol, arachyl alcohol, and behenyl alcohol. Suitable paraffin waxes include natural paraffins, synthetic paraffins, Fischer-Tropsch wax, rice wax, carnauba wax, and chlorinated hydrocarbons. Suitable amide waxes include stearamide, oleamide, palmitamide, lauramide, behenamide, methylene bisstearamide, and ethylene bisstearamide. Suitable polyhydric alcohol esters include glycerol stearate, glycerol ricinoleate, glycerol monobehenate, sorbitan monostearate, propylene glycol monostearate and sorbitan trioleate.

Preferred waxes include linear or branched polyalkylene waxes such as polyethylenes, polypropylenes, ethylene propylene copolymers, and mixtures thereof. In one embodiment preferred waxes are synthetic wax, such as synthetic polyolefin waxes. In one embodiment the wax is selected from the group consisting of polyethylene waxes, polypropylene waxes, and mixtures thereof. In one embodiment the wax is free of natural waxes such as carnauba wax, rice wax, jojoba oil wax, Fischer-Tropsch wax, and bees wax.

Generally, the wax is incompatible with the chosen resin or combination of resins. As used herein, "incompatible" is intended to mean that the wax, if mixed with the resin or combination of resins in the absence of the functionalized enhancing agent, forms a wax domain of average diameter of at least about 0.5, preferably at least about 1.5, more preferably at least about 2 micrometers at a wax level of 1%, by weight.

The wax, preferably a polyolefin wax, may have a number-average molecular weight of less than about 15,000, preferably less than about 10,000, and more preferably less than about 2,000. In one embodiment the wax, preferably a polyolefin wax, has a number-average molecular weight of less than about 10,000, preferably in the range of from about 300 to about 5,000, more preferably from about 400 to about 3,000. In another embodiment the wax is a polyolefin wax, preferably a linear polyethylene wax, having a number-average molecular weight of from about 400 to about 3,000, preferably about 400 to about 2,000. Generally the melting point of the wax is in the range from about 60° C. to about 135° C., preferably about 70° C. to about 120° C.

Release agents in accordance with the present invention may be used to improve the release/transparency window of an overhead projection substrate of a color toner image. Improving the release/transparency window may be particularly desirable when using a printer having a low oil or oil-less fuser roll. As used herein, a "low oil fuser roll" is intended to mean a fuser roll which sloughs off an amount of oil to the page of no greater than about 5 mg, preferably no greater than about 3 mg, even more preferably no greater than about 1 mg oil per page. A preferred method of improving the release/transparency window of an overhead projection substrate of a color toner image using a low oil or oil-less fuser roll comprises the step of printing the overhead projection substrate with a composition comprising toner particulates, wherein the toner particulates comprise a colorant, resin and a release agent comprising, by weight of total blend of wax and functionalized enhancing agent, no more than about 50%, preferably no more than 45%, by weight, of a wax having an acid value of no more than about 10 and at least about 50%, preferably at least about 55%, by weight, of a functionalized enhancing agent having an acid value from about 10 to about 100.

In one embodiment, toner particulates comprise a release agent comprising at least about 50%, more preferably at least about 55%, even more preferably at least 60%, by weight, functionalized enhancing agent, and no more than about 50%, preferably no more than about 45%, even more preferably no more than 30%, by weight, wax. Generally the toner particulates comprise, by weight, a greater amount of functionalized enhancing agent than wax. In one embodiment, the weight ratio of the wax to the functionalized enhancing agent is from about 1:1 to about 1:9, preferably from about 1:1 to about 1:6, more preferably from about 1:1 to about 1:3, while in another embodiment, the weight ratio of the wax to the functionalized enhancing agent is from about 1:1 to about 1:50, more preferably from about 1:1 to about 1:9.

The toner particulate may comprise the release agent in a total amount of from about 0.1% to about 10%, preferably from about 1% to about 8%, more preferably from about 2% to about 6%, by weight of toner particulate. Generally the toner particulate comprises from about 0.1% to about 5%, preferably from about 0.75% to about 3%, by weight of particulate, of functionalized enhancing agent, while in another embodiment the toner particulate comprises from about 0.1% to about 6%, preferably about 1% to about 6%, more preferably about 2% to about 4%, by weight of particulate, of functionalized enhancing agent. In one embodiment, the toner particulate comprises from about 0.1% to about 5%, preferably from about 0.1% to about 3% more preferably from about 0.25% to about 1.25%, by weight of particulate, of wax while in another embodiment the toner particulate comprises from about 0.1% to about 5%, preferably from about 0.1% to about 3%, and more preferably from about 0.5% to about 2%, by weight of particulate, of wax.

In one embodiment the toner composition comprises from about 1% to about 8%, preferably about 2% to about 6%, by weight of toner, total release agent. In one embodiment the toner composition comprises from about 0.1% to about 3%, preferably from about 0.5% to about 2%, wax, preferably polyethylene wax, and from about 1% to about 6%, preferably from about 2% to about 4%, functionalized enhancing agent.

In one embodiment, the toner particulate comprises a functionalized enhancing agent having an acid value of from about 20 to about 50 and a wax having an acid value no greater than about 2.

Generally the release agent domain size of the toner particles is no more than about 4 $\mu$m, preferably no more than about 3.5 $\mu$m, more preferably less than about 3.0 $\mu$m. In one embodiment the domain size of the wax component in the toner particulate is in the range of from about 1 $\mu$m to about 4 $\mu$m, preferably no more than from about 1.5 $\mu$m to about 3.5$\mu$m.

In one embodiment a toner particulate comprises the release agent and an ingredient selected from the group consisting of resins, colorants, charge control agents, fillers such as metal oxides other than those metal oxides used as colorants, surface additives, oils, such as silicone oils, and mixtures thereof. Resins in toner particulates typically serve as binders. In one embodiment, the toner particulate comprises, by weight, from about 20% to about 90%, preferably from about 20% to about 80%, more preferably from about 40% to about 80%, resin, while in another embodiment the toner particulate comprises, by weight, from about 20% to about 95%, preferably from about 40% to about 95%, and more preferably from about 60% to about 95%, resin.

Examples of suitable resins include, but are not limited to acrylic polymers, styrene polymers, polyester polymers, epoxy polymers, phenolic polymers, polyamide polymers, polybutadiene polymers, and mixtures thereof. In one embodiment the binder resin may be a styrene and/or acrylic homopolymer, copolymer, or terpolymer, such as, for example, styrene acrylic copolymers. In one embodiment the toner resin has an acid value of at least about 5, preferably greater than about 5, more preferably from about 10 to about 50.

In one embodiment, the resin comprises a polyester resin. Polyester resins generally have lower melt viscosities and higher mechanical properties than do styrene acrylic resins at a given glass transition temperature and molecular weight. It has been found that the addition of a release agent in accordance with the present invention to a toner comprising polyester resin results in a toner particulate which fuses adequately at high print speeds in monocomponent, contact fusing applications.

Toner particulate may comprise one or more polyester resins, and may comprise polyester resins having different molecular weights or molecular weight distributions. For example, the toner may comprise a first polyester resin having a number-average molecular weight in the range of from about 20,000 to about 35,000 and/or a molecular weight distribution in the range of from about 3 to about 8, and a second polyester resin having a number-average molecular weight in the range of from about 10,000 to about 16,000 and/or a molecular weight distribution in the range of from about 2 to about 6.

Polyester resins may be formed by condensing a polycarboxylic acid component with a polyol component. As used herein, "polycarboxylic acid component" refers to a monomer having at least 2 carboxylic acid moieties, while "polyol component" refers to a monomer having at least 2 hydroxyl moieties. Suitable polycarboxylic acid components include acids, preacids, anhydrides, and esters of succinic acid, n-dodecenylsuccinic acid, n-dodecylsuccinic acid, n-butylsuccinic acid, isododecenylsuccinic acid and iso-octylsuccinic acid, trimellitic acid, phthalic acid, isophthalic acid, terephthalic acid, fumaric acid, adipic acid, maleic acid, and mixtures thereof. Suitable polyols include ethylene glycol, diethylene glycol, propylene glycol, dipropylene glycol, 1,6-hexanediol, 1,4-butanediol, polyoxypropylene bisphenol A, polyoxyethylene bisphenol A, ethylene glycol, propylene glycol, 1,6-hexanediol, and 1,4-butanediol, neopentyl glycol, hydrogenated bisphenol A, polyoxypropylene (2)-2,2-bis(4-hydroxyphenyl)propane, polyoxyester(2)-2,2-bis(4-hydroxyphenyl)propane, polyoxypropylene (6)-2,2-bis(4-hydroxyphenyl)propane, polyoxypropylene (16)-2,2-bis(4-hydroxyphenyl)propane, glycerin, pentaerythritol, trimethylolpropane.

Etherized bisphenols may be obtained by the additional reaction of a bisphenol, preferably bisphenol A, and an alkylene oxide such as ethylene oxide or propylene oxide to form bisphenol alkylene oxide adducts such as bisphenol A propylene oxide adducts and bisphenol A ethylene oxide adduct.

Alkylsuccinic acid or alkenylsuccinic acids having alkyl or alkylene moieties of from 4 to 12 carbon atoms, etherized bisphenol A compounds, terephthalic acids, and esters and anhydrides thereof, and trimellitic acids, and anhydrides and esters thereof, are preferred polycarboxylic acid components.

In one embodiment, the resin comprises a polyester resin with a low softening point. As used herein "low softening point" refers to a softening point of less than about 200° C., preferably less than about 160° C. In another embodiment, the resin comprises a polyester resin having an acid value of at least about 5, preferably at least about 10, more preferably at least about 15.

In one embodiment, the toner comprises polyester resin and a release agent in accordance with the invention, and provides adequate fuse grade performance at a range of state-of-the-art printing speeds. Toners in accordance with this embodiment of the invention have decreased number of fuser jams, picker finger contamination, and hot offset.

In a preferred embodiment the toner particulate further comprises a colorant. Suitable colorants include dyes and pigments. Any commonly employed pigment or dye may be used. Pigments which are suitable colorants includes, but is not limited to, azo pigments such as condensed and chelate azo pigments; polycyclic pigments such as phthalocyanines, anthraquinones, quinacridones, thioindigoids, isoindolinones, and quinophthalones, benzimidazolones, bisacetoarylides, nitro pigments, daylight fluorescent pigments; carbonates; chromates, titanium oxides; zinc oxides; iron oxides, magnetites and carbon blacks. The pigments may be prepared via conventional techniques and may include mixtures of pigments. In one embodiment the toner particulate comprises pigment, preferably black pigment. In a preferred embodiment, the toner particulate comprises from about 2% to about 20%, preferably from about 3% to about 17%, black pigment.

The toner particulate may further comprise a magnetic component. Suitable magnetic components include magnetic pigments, metal oxides and mixtures thereof known in the art and typically employed in toner particulates. In one embodiment the toner particulate comprises iron oxide. Suitable iron oxides include magnetite, hematite, ferrite, and modified forms of such oxides.

The toner particulate may further include one or more charge control agents (CCAs) which stabilize the charge characteristics of the toner composition. Preferably the toner composition is a negatively charged toner, and comprises a negative charge control agent. Negative charge control agents include, but are not limited to, organic metal complexes or chelates, such as a chromium, zinc, iron, titanium, boron, calcium or aluminum complex of an organic compound. Complexes or chelates of organic acids and azo compounds are also suitable. Further examples of charge control agents include various electron attractive/donative inorganic powders, inorganic materials surface treated with a polar material and polar polymer beads. The charge control agent is included in the toner particulate in an amount sufficient to stabilize the charge characteristics.

The toner compositions comprise toner particulates and, typically, extra-particulate additives selected from the group consisting of inorganic oxides, polymeric microspheres, flow or charge additives and mixtures thereof. Suitable extra particulate additives include hydrophobic fumed silica, hydrophobic titania, alumina, zirconia, ceria, zinc oxide, strontium titanate, silicon carbide and others. The toner particulate may have associated on its surface, by weight of total particulate, from about 0.5% to about 3.0%, extra-particulate additives.

In one preferred embodiment the toner is used in preparing the colored overhead transparencies, referred to as "colored overhead transparency toner". The colorants are those suitable for use in preparing colored overhead transparencies, such as black, cyan, yellow and magenta colorants. More preferably the colorants are pigments suitable for use in preparing colored overhead transparencies, such as Pigment Yellow 17, Pigment Yellow 155, Pigment Yellow 180, Pigment Yellow 93, Pigment Blue 15:3, Pigment Red 122, Pigment Red 57:1 and carbon black.

Preferably the release agent in the colored overhead transparency toner comprises no more than about 50%, preferably no more than about 45%, more preferably no more than about 35%, by weight, wax and at least about 50%, preferably at least about 55% and more preferably at least about 65%, by weight, of a functionalized enhancing agent. The weight ratio of the wax to the functionalized enhancing agent is from about 1:1 to about 1:50, preferably from about 1:1 to about 1:10.

The functionalized enhancing agent of colored overhead transparency toner comprises at least one moiety selected from acid groups, acid derivatives and mixtures thereof. As used herein, "acid derivatives" is intended to include organic acid anhydrides, acid anhydride/half esters, esters and mixtures thereof. Generally the functionalized enhancing agent has an acid value of from about 20 to about 100.

The wax of the colored overhead transparency toner may comprise a wax selected from the group consisting of polyalkylenes and mixtures thereof. Preferably the wax comprises a polyethylene wax having a weight average molecular weight of from about 300 to about 3,000. Generally the wax has an acid value no greater than about 10.

A preferred colored overhead transparency toner particulate comprises, by weight, from about 60% to about 95% resin, from about 0.1% to about 5% wax, and from about 0.1% to about 5% functionalized enhancing agent. The weight ratio of the wax to the functionalized enhancing agent is from about 1:1 to about 1:50. In one embodiment the resin comprises at least one resin selected from the group consisting of resins with an acid value greater than about 2 and mixtures thereof. A preferred colored overhead transparency toner particulate may further comprise an appropriate colorless charge control agent, filler or fillers, and surface additives including but not limited to flow agents, inorganic oxides, polymeric microspheres and other surface additives known in the art.

The wax and the functionalized enhancing agent of the colored overhead transparency toner form a wax/enhancer blend. The melting point(s) of the wax/enhancer blend is below the onset-of-flow temperature of the binder resin. As used herein, "onset-of-flow," also commonly known as a Shimadzu T1, is intended to refer to the temperature at which a toner will flow a distance of 1 mm through a 1 mm diameter die under a weight of 20 kg. The colored overhead transparency toner particulate has a maximum release agent domain size of from about 1 micron to about 6 microns.

In another preferred embodiment the toner is a black toner. The black toner particulate comprises, by weight, from about 40% to about 95%, preferably from about 60% to about 90%, binder resin; from about 2% to about 20%, preferably from about 3% to about 17%, of a black colorant or mixture of black colorants; from about 0.25% to about 5%, preferably from about 0.5% to about 4%, charge controlling additive; and from about 1% to about 10%, preferably from about 1.5% to about 6%, more preferably from about 1.5% to about 4%, release agent. Preferably the black colorant is a black pigment such as carbon black.

In one embodiment the release agent of the black toner particulate comprises from about 15% to about 75%, preferably from about 20% to about 60%, and more preferably from about 25% to about 50%, and even more preferably no more than about 45%, by weight, wax and from about 25% to about 85%, preferably from about 40% to about 80%, and more preferably from about 50% to about 75%, and even more preferably at least about 55%, by weight, functionalized enhancing agent.

In one embodiment of the invention a black toner composition comprises, by weight, from about 70% to about 90% resin, such as a polyester resin or mixture of polyester resins; from about 4% to about 30% black colorant, such as a black pigment; from about 0.5% to about 2.0% wax; from about 0.75% to about 2.5% functionalized enhancing agent; from about 0.5% to about 5% charge control additive; and from about 0.5% to 2% additional fillers and/or release agents.

The functionalized enhancing agent for the black toner comprises at least one moiety selected from acid groups, acid derivatives and mixtures thereof. Suitable acid derivatives include organic acid anhydrides, acid anhydride/half esters, esters and mixtures thereof.

Generally the functionalized enhancing agent has an acid number of from about 10 to about 150, preferably from about 15 to about 100, and more preferably from about 20 to about 75; and a number-average molecular weight of from about 400 g/mol to about 15,000 g/mol, preferably from about 500 g/mol to about 10,000 g/mol, and more preferably from about 500 g/mol to about 6,000 g/mol.

The wax of the black toner generally comprises at least one wax selected from the group consisting of polyalkylenes and mixtures thereof. Suitable alkylene waxes include polyethylene waxes, polypropylene waxes, polypropylene-polyethylene (PP-PE) copolymer waxes, and mixtures thereof. Generally the wax has an acid number less than about 20, preferably less than about 10 and more preferably less than about 5, and a number-average molecular weight of from about 300 g/mol to about 10,000 g/mol, preferably from about 400 g/mol to about 6,000 g/mol, and more preferably from about 400 g/mol to about 3,000 g/mol.

Generally the release agent in the black toner has a maximum domain diameter (as measured using Scanning Electron Microscopy, SEM) of from about 0.5 $\mu$m to about 5 $\mu$m, preferably from about 1.5 $\mu$m to about 4 $\mu$m, and more preferably from about 1.75 $\mu$m to about 3.5 $\mu$m. The black toner particulates typically have a volume-average median diameter of from about 7 $\mu$m to about 13 $\mu$m.

The black toner's binder resin may comprise at least one resin selected form the group consisting of polyester polymers and copolymers, styrenic polymers an copolymers, acrylic polymers an copolymers, polyolefin polymers and copolymers, epoxy polymers and copolymers, polyurethane polymers an copolymers, and mixtures thereof. In a preferred embodiment the binder resin comprises a binder selected from the group consisting of polyester binders and mixtures thereof. Generally the black toner's binder resin has an acid number of from about 2 to about 100, preferably from about 8 to about 75, and more preferably from about 10 to about 50; an onset-of-flow temperature of from about 95° C. to about 150° C., preferably from about 105° C. to about 140° C., and more preferably from about 110° C. to about 135° C.; an onset glass transition temperature (Tg from Differential Scanning Calorimetry, DSC) of from about 50° C. to about 80° C., preferably from about 54° C. to about 75° C., more preferably from about 54° C. to about 70° C., and even more preferably from about 55° C. to about 65° C. In one embodiment the resin has a softening temperature of from about 90° C. to about 150° C., preferably from about 100° C. to about 140° C. The toner particulates of the present invention are prepared in accordance with methods generally known in the toner art. For example, resins and waxes may be kneaded together, pulverized and classified to provide toner particles of a desired size. Kneading may be performed with a heat-kneading machine such as a heat roller, a kneader, or an extruder. Milling or pulverizing may be performed with any suitable crushing or grinding mill.

The toner particulates may have a diameter in the range of from about 5 to about 25 $\mu$m, and more preferably in the range of from about 6 to about 13 $\mu$m. In one embodiment the toner particle distribution has a volume-average median diameter between about 6.5 $\mu$m and about 13 $\mu$m.

In one embodiment, the toner particulate ingredients are blended and melt mixed. The composite is then milled and classified to obtain toner particulates of the desired size. The milled and classified toner particulates may be blended in a high-speed blender with extraparticulate additives (EPA). Suitable EPAs may include inorganic oxides which may be fumed or hydrophobically treated, and include silica, titania and alumina, among others. Suitable silicas include fumed silica and hydrophobically treated fumed silica, preferably the silica is a hydrophobically treated fumed silica.

The following examples are set forth to demonstrate the methods, release agents and toner particulates of the present invention. Throughout the examples and the present specification, parts and percentages are by weight unless otherwise specified. The following examples are illustrative only and are not intended to limit the scope of the methods, release agents, toner particulates and toner compositions of the invention as defined by the claims.

EXAMPLE 1

Suitable toner particulate compositions are set forth below in Tables 2 and 3. Percentages and parts in the examples and throughout the specification are by weight unless indicated otherwise.

TABLE 2

Percent By Weight Ingredients in Black Toner Compositions

| Material | Toner 1 | Toner 2 | Toner 3 | Toner 4 | Toner 5 | Toner 6 | Toner 7 |
|---|---|---|---|---|---|---|---|
| Polyester resin[1] | 80.2% | 80.2% | 80.2% | — | 90.2% | 79.7% | 70.2% |
| Styrene-acrylic resin[2] | — | — | — | 79.2% | — | — | — |
| Black Pigment | 15.0% | 15.0% | 15.0% | 15.0% | 5.0% | 15.0% | 25.0% |
| J-797 Functionalized enhancing agent[3] | 1.5% | 1.5% | — | 1.5% | 1.5% | 2.5% | 1.5% |
| K-761 Functionalized enhancing agent[4] | — | — | 1.5% | — | — | — | — |
| POLYWAX 500 Wax[5] | 1.0% | — | 1.0% | 1.0% | 1.0% | 0.5% | 1.0% |
| POLYWAX 400 Wax[6] | — | 1.0% | — | — | — | — | — |
| Charge control agent | 1.0% | 1.0% | 1.0% | 2.0% | 1.0% | 1.0% | 1.0% |
| Additional fillers/release agents | 1.3% | 1.3% | 1.3% | 1.3% | 1.3% | 1.3% | 1.3% |

[1]Binder Resin H available from Kao. Resin must have an acid value greater than 0.
[2]Acid value from about 8 to about 15
[3]SEPARAGENT J-797 from Chukyo Yushi Co., Ltd., maleic anhydride half ester functionalized polyethylene
[4]K-761 from Chukyo Yushi Co., Ltd.
[5]POLYWAX 500 from Baker Petrolite
[6]POLYWAX 400 from Baker Petrolite

TABLE 3

Color Transparency Toner Composition

| Material | Percent by Weight |
|---|---|
| Polyester Resin H[1] | 78.5–82.5% |
| Hostacopy M501[2] | 15% |
| Functionalized enhancing agent/wax[3] | 0.5–1%/1.8–3.5% |
| Charge control agent | 2.5% |

[1]A product of Kao Corp.
[2]Pigment Red 122 masterbatch available from Clariant.
[3]See Table 4 below for specific release agent combinations

EXAMPLE 2

It has been found that the combination of a functionalized enhancing agent and wax allows for a greater level of total release agent without any detrimental effect on print quality. As used herein, "total release agent" refers to the combination of the wax and the functionalized enhancing agent. Comparative examples and samples of color toners in accordance with the invention are set forth below in Table 4. The comparative examples and samples set forth in Table 4 all contain a broad molecular weight distribution polyester resin with low levels of gel (less than about 50% gel) and a high acid value (at least about 30). As used herein, gel content, or % gel, is the amount of resin, by weight, which is insoluble in a solvent, such as chloroform.

TABLE 4

Percentages of Release Agent in Toner

| Sample | Wax[1] | Functionalized Enhancing Agent[2] | Total Release Agent |
|---|---|---|---|
| Comparative Example 1 | 2% | — | 2% |
| Comparative Example 2 | 2.5% | — | 2.5% |
| Comparative Example 3 | 3% | — | 3% |
| Comparative Example 4 | — | 3% | 3% |
| Comparative Example 5 | — | 4% | 4% |

TABLE 4-continued

Percentages of Release Agent in Toner

| Sample | Wax[1] | Functionalized Enhancing Agent[2] | Total Release Agent |
|---|---|---|---|
| Sample 1 | 1% | 1.8% | 2.8% |
| Sample 2 | 1% | 2.1% | 3.1% |
| Sample 3 | 1% | 2.5% | 3.5% |
| Sample 4 | 1% | 3.2% | 4.2% |
| Sample 5 | 0.5% | 3.5% | 4.0% |

[1]POLYWAX 500
[2]SEPARAGENT J-797

Toner performance, in this simple case, is measured by fuser release and film onset. Fuser release score assesses the tendency of a toner to wrap on the hot roll in a fuser assembly. The angle of wrap refers to the deviation of the substrate from the original path. A substrate, preferably paper, having toner on its surface is passed along a substrate path between a hot roll and a back up roll. If there is no wrap, the substrate proceeds with 0 degrees of deviation from the substrate path, but if there is some degree of wrap, the substrate will deviate from the original path. The degree of deviation is the wrap angle.

The angle of wrap is gauged employing a printed sample with a mass per unit area of approximately 1 mg of toner per cm over a range of 50 degrees appropriate to a given resin system then summed to provide a total score. A value of "0" indicates no wrapping, while a value of "180", indicates a complete wrap at an indicated temperature. Intermediate wrapping is assessed as "90". Hot offset is scored as "200". An example of scoring is set forth below in Table 5.

TABLE 5

Fuser Release Scoring

| Fuser Temperature (C.) | 150 | 160 | 170 | 180 | 190 | 200 | Total Release |
|---|---|---|---|---|---|---|---|

TABLE 5-continued

| Fuser Release Scoring | | | | | | | |
|---|---|---|---|---|---|---|---|
| Wrap Angle | 0 | 90 | 180 | 180 | 180 | 200 | Score 830 |

Filming onset indicates the first appearance of flaws in the print, and is measured in thousands (K) of pages. Usage and waste toner are measured as averages over life in mg/page while efficiency is measured as a ratio between total toner usage and toner to the page ((total—waste)/total).

Preferably a toner exhibits good release, filming performance, usage and efficiency. Preferably the release score is less than about 360, more preferably less than about 180, most preferably zero. Filming is preferably absent for a sufficient print cartridge lifetime, preferably at least about 5 thousand pages, more preferably at least about 10 thousand pages. Waste, usage and efficiency values are given for comparative purposes only.

TABLE 6

Toner Performance
Relevant release temperature range 150° C. to 200° C.

| Sample | Fuser Release | Film Onset | Usage | Waste Toner | Efficiency |
|---|---|---|---|---|---|
| Comparative Example 1 | 540 | >20K | 13.2 | 1.5 | 88.6% |
| Comparative Example 2 | 360 | 1K | 25.8 | 5.0 | 80.6% |
| Comparative Example 3 | 0 | 1K | 40.1 | 6.9 | 82.8% |
| Comparative Example 4 | 180 | 10K | 15.8 | 2.8 | 82.2% |
| Comparative Example 5 | 360 | 5K | 11.2 | 1.8 | 86.2% |
| Sample 1 | 0 | >20K | 13.1 | 3.4 | 74% |
| Sample 2 | 0 | >20K | 14.4 | 4.3 | 70% |
| Sample 3 | 0 | >20K | 10.9 | 1.9 | 82.6% |
| Sample 4 | 0 | >10K | 8.8 | 1.0 | 88.6% |

Sample 3, which comprises 3.5% of the release agent mixture in accordance with the invention, demonstrates comparable usage to and better release and film offset than Comparative Examples 1-3, toners comprising wax only or Comparative Examples 4 and 5, toners comprising functionalized enhancing agent only.

EXAMPLE 3

Comparative examples and samples in accordance with the invention are set forth below in Table 7. The comparative examples and samples set forth in Table 7 all contain a narrow molecular weight distribution polyester resin with about zero % gel, and an acid value of about 12. Percentages are by weight.

TABLE 7

Percentages of Wax and Functionalized Enhancing Agent in Toner

| Sample | Wax[1] | Functionalized Enhancing Agent[2] | Total Release Agent |
|---|---|---|---|
| Comparative Example 6 | 2.5% | — | 2.5% |
| Comparative Example 7 | 3.5% | — | 3.5% |
| Comparative Example 8 | — | 3.5% | 3.5% |

TABLE 7-continued

Percentages of Wax and Functionalized Enhancing Agent in Toner

| Sample | Wax[1] | Functionalized Enhancing Agent[2] | Total Release Agent |
|---|---|---|---|
| Comparative Example 9 | — | 4.5% | 4.5% |
| Sample 6 | 1% | 3% | 4% |
| Sample 7 | 1.5% | 2.5% | 4% |
| Sample 8 | 1.5% | 3.5% | 5% |
| Sample 9 | 0.5% | 3.5% | 4% |

[1]POLYWAX 500
[2]SEPARAGENT J-797

Toner performance is measure by fuser release and film onset, as set forth in Table 8, next page.

TABLE 8

Toner Performance
Relevant release temperature range is 140° C. to 190° C.

| Sample | Fuser Release | Film Onset |
|---|---|---|
| Comparative Example 6 | 940 | >25K |
| Comparative Example 7 | 540 | 5K |
| Comparative Example 8 | 1100 | >25K |
| Comparative Example 9 | 900 | 5K |
| Sample 6 | 0 | >20K |
| Sample 7 | 0 | >10K |
| Sample 8 | 0 | >10K |
| Sample 9 | 90 | >20K |

As indicated by Sample 8, a total of 5% of the release agent in accordance with the invention may be used without decreasing the film onset to five thousand pages. In contrast, Comparative Example 7, comprising only 3.5% wax, and Comparative Example 9, comprising only 4.5% functionalized enhancing agent, both exhibit film onset values of five thousand, indicating that the functional level of the individual release additives has been exceeded without achieving the desired release characteristics. Further, all of the samples in accordance with the invention exhibit good fuser release values at acceptable levels of film onset, that is, fuser release values of less than 180 and a minimum of 10,000 film-free pages.

EXAMPLE 4

In the fuser jam stress test a cartridge is filled with toner and all-black pages are printed (100% coverage) on the second page of a duplexed print until either the fuserjams or the cartridge runs out of toner. The number of pages prior to jam is recorded. Generally the printer is run at a specified fuser temperature (about 221+/−2° C.) and print speed, 20 pound paper is used, and the paper is run with no stops. As will be apparent to one of skill in the art, the more pages printed prior to first jam the better the performance of the toner.

The control examples exhibited page count to first jam of from about 0 to about 100 pages, while samples in accordance with the invention exhibited a page count to first jam of from about 300 to about 800 pages. Generally, toners in accordance with the invention exhibit a page count to first jam of at least about 200, preferably greater than 300, more preferably greater than 500, pages.

EXAMPLE 5

The fuser jam stress test is the most stressful case for printer jamming because each page comprises the highest possible mass per unit area (100% coverage). Number of pages to jam can also be measured by using a normal print quality test using a three page and pause mode with about 3% of the page covered with toner.

In an additional fuser jam test, the testing protocol utilizes a 3 page and pause mode with about 3% coverage. Number of jams per cartridge life is measured. Back side smudge due to picker finger contamination is also determined. Picker fingers are tiny pieces of plastic that ride along the fuser hot roll and help to pick the paper from the fuser after exiting the fuser nip. If toner builds up on these picker fingers, release from the fuser is poor. If the printer sits idle for a period of several hours, the toner contamination on the picker fingers may cool and become brittle, and the next time the printer is started, the brittle toner flakes off back onto the hot roll and ends up on the back side of the paper causing back side smudges. Back side smudge ratings are determined on a scale of from 1 to 5, wherein 5 equals no smudges and 1 equals the worst smudging. In Table 9 set forth below, comparative examples 10–13 are toner compositions comprising, by weight, 1% of a polyethylene wax, while samples 8–13 are toners in accordance with the invention comprising, by weight, 1% of polyethylene wax and 1.5% of functionalized enhancing agent.

TABLE 9

Picker Finger Back Side Smudge and Fuser Jam

| Sample | Picker Finger Back Side Smudge | Fuser Jam Per Cartridge Life |
|---|---|---|
| Comparative Example 10 | 4 | 1 |
| Comparative Example 11 | 1 | 1 |
| Comparative Example 12 | 1.5 | 7 |
| Comparative Example 13 | 1.5 | 13 |
| Sample 8 | 4.5 | 0 |
| Sample 9 | 3 | 0 |
| Sample 10 | 3.8 | 0 |
| Sample 11 | 4.4 | 0 |
| Sample 12 | 4 | 0 |
| Sample 13 | 4 | 0 |

As set forth in Table 9 above, none of the toner compositions comprising a combination of functionalized enhancing agent and wax in accordance with the invention exhibited fuser jams. Further, while the average picker finger back side smudge rating is only 2 for comparative examples 10–13, the picker finger back side smudge rating is an average 3.5 for samples 8–13. Generally in the fuser jam tests, toner compositions in accordance with the invention exhibited 0 jams per cartridge life in a normal mode test, and exhibited a back side smudge rating of at least 3, preferably more than 3.

EXAMPLE 6

Wax domain size is determined by examining the fracture surface of a cryogenically fractured toner sample with scanning electron microscopy. The largest wax domain is recorded. Toners comprising, by weight, about 1% of a 500 g/mol number-average molecular weight polyethylene wax and about 1.5% of a functionalized enhancing agent exhibited domain sizes of the wax/functionalized enhancing agent blend from about 1.5 to about 3.5 micrometers, while toners comprising, by weight, about 1% of polyethylene wax and about 1.75% of a functionalized enhancing agent exhibited domain sizes of from about 2.0 to about 4.0 micrometers. In contrast, when about 2.5%, by weight, of the polyethylene wax is added to toner, the wax domains are at least double the size, that is, in the range of from about 5 to about 6 micrometers. Thus, in toner compositions comprising the claimed release agent increased amounts of total release agent may be added without greatly decreasing the domain size, demonstrating the failure of the enhancing agent to act as a compatibilizer.

Additional embodiments and modifications within the scope of the claimed invention will be apparent to one of ordinary skill in the art. Accordingly, the scope of the present invention shall be considered in the terms of the following claims, and is understood not to be limited to the details of the compositions or methods described in the specification.

What is claimed is:

1. A toner particulate comprising a resin and a release agent, said release agent comprising, by weight of total release agent, no more than about 50% polyethylene wax and at least about 50% maleic anhydride ester functionalized polyethylene as a functionalized enhancing agent;

wherein the wax has a number-average molecular weight of no greater than about 10,000;

wherein the wax and the functionalized enhancing agent form a wax/enhancer blend; and wherein said toner has a maximum wax/enhancer blend domain size from about 1.5 micron to about 4 microns.

2. A toner particulate according to claim 1, wherein the wax comprises a polyethylene wax having a number-average molecular weight of from about 300 to about 3000.

3. A toner particulate according to claim 1, wherein the functionalized enhancing agent has an acid value from about 20 to about 100 and the wax has an acid value no greater than about 10.

4. A toner particulate according to claim 1, wherein the release agent comprises, by weight, no more than about 45% wax having an acid value no greater than about 5 and at least about 55% functionalized enhancing agent having an acid value of from about 20 to about 75.

5. A toner particulate according to claim 4, wherein the wax and the functionalized enhancing agent form a wax/enhancer blend, and further wherein the melting point(s) of the wax/enhancer blend is/are below the onset-of-flow temperature of the resin.

6. A toner particulate according to claim 1, comprising, by weight: from about 60% to about 95% resin; from about 0.1% to about 5% wax; and from about 0.1% to about 5% functionalized enhancing agent.

7. A toner particulate according to claim 6, wherein the weight ratio of the wax to the functionalized enhancing agent is from about 1:1 to about 1:50.

8. A toner particulate according to claim 6, wherein the resin is selected from the group consisting of resins having an acid value greater than about 2 and mixtures thereof.

9. A toner particulate comprising a resin and a release agent, said release agent comprising, by weight of total release agent, no more than about 45% wax having an acid value not great than about 5 and at least about 55% maleic anhydride ester functionalized polyethylene having an acid value of from about 20 to about 75 as a functionalized enhancing agent;

wherein the wax has a number-average molecular weight of not great than about 10,000;

wherein the wax and the functionalized enhancing agent form a wax/enhancer blend;

wherein the melting points(s) of the wax/enchancer blend is/are below the onset-of-flow temperature of the resin; and further wherein said toner has a maximum wax/enhanced blend domain size of from about 1.5 micron to about 4 microns.

10. A toner particulate comprising a resin, a colorant, a charge controlling additive and a release agent, wherein the release agent comprises from about 15% to about 75%, by weight, polyethylene wax and from about 25% to about 85%, by weight, maleic anhydride ester functionalized polyethylene as a functionalized enhancing agent;

wherein the wax has a number-average molecular weight of no greater than about 10,000; and wherein the release agent has a maximum domain diameter of from about 1 μm to about 6 μm.

11. A toner particulate according to claim 10, wherein the release agent comprises by weight from about 20% to about 60% of said wax.

12. A toner particulate according to claim 10, wherein the release agent comprises by weight from about 25% to about 50% of said wax.

13. A toner particulate according to claim 10, wherein the functionalized enhancing agent has an acid number from about 10 to about 150.

14. A toner particulate according to claim 10, wherein the functionalized enhancing agent has a number-average molecular weight of from about 400 g/mol to about 15,000 g/mol.

15. A toner particulate according to claim 10, wherein the wax has an acid number less than 10.

16. A toner particulate according to claim 10 wherein said wax has a number-average molecular weight of from about 500 g/mol to about 10,000 g/mol.

17. A toner particulate according to claim 10, comprising by weight from about 1.5% to about 6% release agent.

18. A toner particulate according to claim 10, having a volume-average median diameter in the range of from about 7 μm to about 13 μm.

19. A toner particulate according to claim 10, wherein the resin comprises at least one resin selected from the group consisting of polyester polymers and copolymers, styrenic polymers and copolymers, acrylic polymers and copolymers, polyolefin polymers and copolymers, epoxy polymers and copolymers, polyurethane polymers and copolymers, and mixtures thereof.

20. A toner particulate according to claim 19, wherein the resin has an acid number of from about 8 to about 75.

21. A toner particulate according to claim 19, wherein the resin has a softening temperature in the range of from about 100° C. to about 140° C.

22. A toner particulate according to claim 19, wherein the resin has an onset glass transition temperature of from about 54° C. to about 70° C.

23. A toner particulate according to claim 19, wherein the resin comprises a polyester resin or mixture of polyester resins.

24. A toner particulate comprising:

(a) a resin;

(b) a polyethylene wax having a number-average molecular weight less than about 5000, and (c) a functionalized enhancing agent comprising a polyethylene having at least one maleic half ester moiety grafted onto the polyethylene having an acid value of less than about 20;

wherein the weight ratio of wax to functionalized enhancing agent is about 1:1 to about 1:9;

wherein the wax and the functionalized enhancing agent form a wax/enhancer blend; and wherein the toner has a maximum wax/enhancer blend domain size of from about 1.5 micron to about 4 microns.

25. A toner particulate comprising a resin, a colorant, a charge controlling additive and a release agent, wherein the release agent comprises from about 15% to about 75%, by weight, wax and from about 25% to about 85%, by weight, maleic anhydride ester functionalized polyethylene as a functionalized enhancing agent; wherein the release agent has a maximum domain diameter of from about 1.5 μm to about 4.0 μm.

* * * * *